United States Patent [19]

Van Den Berg

[11] Patent Number: 5,026,312

[45] Date of Patent: Jun. 25, 1991

[54] METHOD OF MANUFACTURING A SHADOW MASK, SHADOW MASK MANUFACTURED ACCORDING TO SUCH A METHOD, AND COLOR DISPLAY TUBE COMPRISING SUCH A SHADOW MASK

[75] Inventor: Adrianus H. M. Van Den Berg, Eindhoven, Netherlands

[73] Assignee: U.S. Philips Corporation, New York, N.Y.

[21] Appl. No.: 526,946

[22] Filed: May 17, 1990

Related U.S. Application Data

[63] Continuation of Ser. No. 434,639, Nov. 8, 1989, abandoned, which is a continuation of Ser. No. 293,559, Jan. 3, 1989, abandoned, which is a continuation of Ser. No. 4,930, Jan. 20, 1987, abandoned.

[30] Foreign Application Priority Data

Jan. 23, 1986 [NL] Netherlands ..... 8600141

[51] Int. Cl.[5] ..... H01J 9/00

[52] U.S. Cl. ..... 445/47; 445/58

[58] Field of Search ..... 445/37, 47, 58; 313/402; 148/287

[56] References Cited

U.S. PATENT DOCUMENTS

| | | | |
|---|---|---|---|
| 4,427,396 | 1/1984 | Van Den Berg | 445/47 |
| 4,612,061 | 9/1986 | Suzuki et al. | 445/47 X |
| 4,698,545 | 10/1986 | Inabe et al. | 313/402 |

FOREIGN PATENT DOCUMENTS

| | | | |
|---|---|---|---|
| 2532108 | 2/1984 | France | 148/6.35 |
| 3341 | 1/1982 | Japan | 445/47 |

*Primary Examiner*—Kenneth J. Ramsey

*Attorney, Agent, or Firm*—Norman N. Spain

[57] ABSTRACT

A shadow mask sheet manufactured from an iron-nickel alloy is drape-drawn by means of a drawing process to form a shodow mask 15. Prior to the actual drawing process the shadow mask sheet is subjected to an annealing treatment. After the drawing process the shadow mask is successively subjected to a complementary annealing treatment in a non-oxidizing gas atmosphere at a temperature between 700° C. and 1200° C. to improve the magnetic screening properties of the shadow mask 15, and to an annealing treatment in an oxidizing gas atmosphere. After oxidation the shadow mask 15 is connected on a supporting frame 17 which may be subjected to an annealing treatment in a non-oxidizing gas atmosphere and then to an oxidizing annealing treatment.

7 Claims, 1 Drawing Sheet

METHOD OF MANUFACTURING A SHADOW MASK, SHADOW MASK MANUFACTURED ACCORDING TO SUCH A METHOD, AND COLOR DISPLAY TUBE COMPRISING SUCH A SHADOW MASK

This is a continuation of application Ser. No. 434,639, filed Nov. 8, 1989, abandoned which is a continuation of Ser. No. 293,559 filed Jan. 3, 1989 (abandoned), which was a continuation of Ser. No. 004,930 filed Jan. 20, 1987 (abandoned).

The invention relates to a method of manufacturing a shadow mask from a shadow mask sheet of an iron-nickel alloy, in which method the shadow mask sheet is successively annealed, drape drawn to form a shadow mask, and then oxidized.

The invention also relates to a shadow mask manufactured according to the method of the invention.

The invention furthermore relates to a colour display tube comprising a shadow mask according to the invention.

A colour display tube is sensitive to external magnetic fields which may detrimentally influence the operation of the colour display tube. One of these magnetic interference fields is the earth's magnetic field. Therefore the colour display tube should be provided with an effective magnetic screening. An envelope of a soft magnetic material can provide an effective protection with respect to cross magnetic interference fields in the colour display tube. However, such an envelope may not be provided in front of the display window of the colour display tube in order to make axial fields in the colour display tube inoperative. A shadow mask consisting of a soft magnetic material provides a reasonable screening for axial fields. Nevertheless the influencing of the operation of the colour display tube by axial fields constitutes a great problem in optimizing the magnetic screening of the colour display tube. A soft magnetic material which provides a reasonable magnetic screening is, for example, an alloy consisting essentially of iron and nickel. In a method of manufacturing a shadow mask consisting of a shadow mask sheet of an alloy consisting essentially of iron and nickel, the shadow mask sheet is subjected to an annealing treatment prior to the actual drawing process. This annealing treatment takes place in a reducing gas atmosphere and produces recrystallization of the material as a result of which internal mechanical stresses are removed. Moreover, the carbon content of the material is reduced by diffusion. After said annealing treatment the shadow mask sheet is drape-drawn by mechanical deformation. This drawing process, which takes place at a temperature between 150° C. and 250° C. when the shadow mask is manufactured from an iron-nickel alloy, adversely influences the initially favourable magnetic screening properties of the shadow mask material.

For various reasons it has been common practice to subject a shadow mask, after it has been drape-drawn, to an oxidizing treatment, in which the shadow mask is subjected to an annealing treatment in an oxidizing gas atmosphere. In this manner, for example, the oxidization prevents uncontrolled rusting of the shadow mask. As a result of the oxidation a black oxide layer is formed on the shadow mask.

For this reason the oxidation is also termed blackening. Said oxidized layer provides an improvement of the heat dissipation of the shadow mask by means of radiation.

A shadow mask consisting of an iron-nickel alloy manufactured according to the usual method does not have the desired magnetic screening properties.

It is an object of the invention to provide a method of manufacturing a shadow mask consisting of an iron-nickel alloy, which method provides a shadow mask with improved magnetic screening properties.

According to the invention a method of the type mentioned in the opening paragraph is characterized in that, after drape-drawing and prior to the oxidation, the shadow mask is subjected to a complementry annealing treatment in a non-oxidizing gas atmosphere at a temperature between 700° and 1200° C. In practice it appears that the magnetic screening properties which the shadow mask has after the drawing process are improved by this complementary annealing treatment . It has been found that the complementary annealing treatment should be carried out at temperatures exceeding approximately 700° C. Complementary annealing treatments which take place at temperatures above 1200° C. provide an improvement of the magnetic screening properties but economically are not satisfactory.

An embodiment of a method according to the invention is characterized in that the complementary annealing treatment is carried out at a temperature which is at least substantially equal to the temperature at which the shadow mask sheet is annealed. When the complementary annealing treatment takes place at substantially the same temperature at which the annealing of the shadow mask sheet is carried out, the same furnace which is also used in the annealing treatment of the shadow mask sheet may be used for the complementary annealing treatment.

When the shadow mask is accommodated in the colour display tube, a supporting frame is generally used on which the shadow mask is secured. Before the supporting frame is placed in the colour display tube it is subjected like the shadow mask to an oxidizing treatment. Since the supporting frame is present at substantially the same place in the colour display tube as the shadow mask, the supporting frame may also contribute to the screening of magnetic interference fields present in the axial direction of the tube.

A further embodiment of a method according to the invention in which the shadow mask after the oxidation is connected on a supporting frame, which supporting frame is subjected to an oxidizing treatment, is characterized in that the supporting frame is manufactured from an iron-nickel alloy and the supporting frame, prior to the oxidation, is subjected to a complementary annealing treatment in a non-oxidizing gas atmosphere at a temperature between 700° C. and 1200° C. The complementary annealing treatment of the supporting frame in a non-oxidizing atmosphere produces an improvement of the magnetic screening properties of the material. The temperature range of the complementary annealing treatment has been chosen according to the same considerations as described in the complementary annealing treatment of the shadow mask. In combination with the shadow mask which has obtained better magnetic screening properties as a result of the complementary annealing treatment, a supporting frame which has been subjected to a complementary annealing treatment ensures an improved magnetic screening of axial magnetic interference fields in a colour display tube. As a result of this the operation of the colour display tube is improved.

An embodiment of the invention will now be described in greater detail with reference to the drawing, in which.

Figure 1:
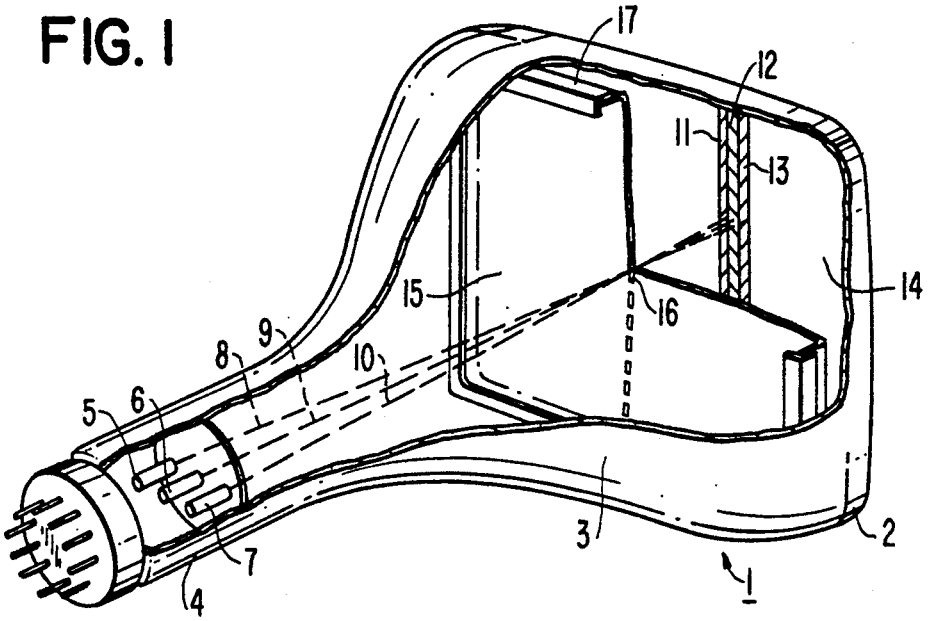
FIG. 1 is a perspective view of a shadow mask and a supporting frame.

The colour display tube shown diagrammatically comprises a glass envelope 1 which is composed of a display window 2, a cone 3, a glass envelope 1 which is composed of a display window 2, a cone 3, a neck 4 and three electron guns 5, 6 and 7 for generating three electron beams 8, 9 and 10. The display window 2 comprises on its inside a large number of triplets of phosphor lines. Each triplet comprises a line 11 consisting of a blue-luminescing phosphor, a line 12 consisting of a green-luminescing phosphor, and a line 13 consisting of a red-luminescing phosphor. All triplets together constitute the display screen 14. A shadow mask 15 which comprises a very large number of apertures 16 through which the electron beams 8, 9 and 10 emanate which each impinge only on phosphor lines of one colour is positioned between the electron guns 5, 6 and 7 and the display screen 14. The shadow mask 15 is provided on a supporting frame 17 which is suspended in the colour display tube. External magnetic fields influence the direction of the electron beams 8, 9 and 10, as a result of which interfering errors occur, for example, colour impurity as a result of mislanding and convergence errors. In order to find out about the influence of external magnetic fields it is feasible to break down such a field with respect to the colour display tube into three mutually perpendicular components. One of these components, the axial component, operates along the tube axis. A shadow mask 15 of a soft-magnetic material can provide an effective screening with regard to said axial interference field. A soft-magnetic material having good magnetic screening properties is an alloy consisting essentially of iron and nickel, the content of nickel being, for example, between 35 and 37%. In addition to iron and nickel, the alloy comprises carbon and other impurities. The manufacture of a shadow mask from such an alloy can be carried out as follows. An apertured shadow mask sheet consisting of an iron-nickel alloy is subjected to an annealing treatment at a temperature, for example, between 700° and 820° C. for a period of time which is sufficient to produce full recrystallization of the material of the shadow mask sheet. The mechanical stresses in the material are reduced by said recrystallization. The annealing treatment is carried out in a non-oxidizing atmosphere, for example in a hydrogen-containing nitrogen atmosphere (6% $H_2$, balance $N_2$). The carbon content in the iron-nickel alloy is reduced by the hydrogen. In a shadow mask manufactured from an iron-nickel alloy the annealing treatment also serves to reduce the tensile stresses in which the 0.2% proof stress of the material reaches such a value that a reproducible drawing process is obtained. For the sake of this reproducibility the shadow mask sheet is not drapedrawn at room temperature but at an elevated temperature, for example, at a temperature between 150° C. and 250° C.

A drawing process of a shadow mask will be described with reference to FIG. 2.

Figure 2:
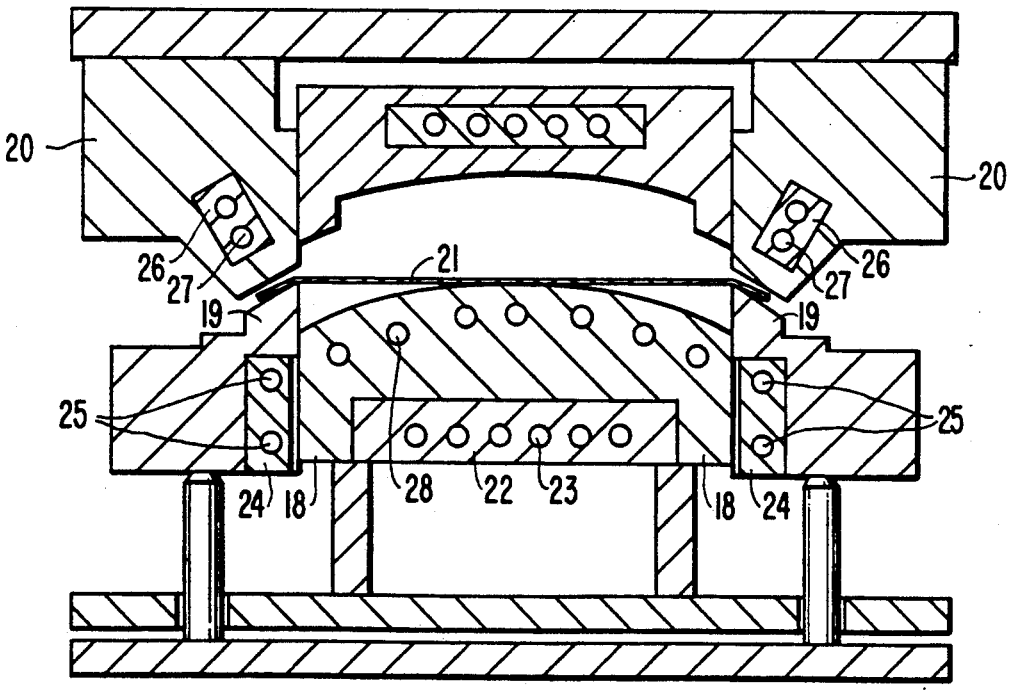
FIG. 2 is a diagrammatic sectional view for drape drawing a shadow mask sheet.

FIG. 2 is a diagrammatic sectional view of advice for drape drawing a shadow mask sheet. The device comprises a draw die 18 (also termed mandril), a pressure ring 19 (also termed pleat holder) and a draw ring 20. A rectangular shadow mask 21 is laid on the draw die 18. The draw ring 20 is moved vertically towards the pressure ring 19, as a result of which the shadow mask sheet 21 is clamped on two oppositely located sides between the pressure ring 19 and the draw ring 20. Drawing the shadow mask sheet 21 to the desired shape is done by lowering the draw ring 20 and the pressure ring 19 simultaneously. The shadow mask sheet 21 is then pulled over the draw die 18. During this drawing process the temperature of the shadow mask sheet 21 is kept at approximately 200° C. In order to realise this, the draw die 18 comprises a copper block 22 in which electric heating elements 23 are inserted. Similarly, the draw ring 19 is provided with copper blocks 24 and heating elements 25 and the draw ring 20 is provided with copper blocks 26 and heating elements 27. In order to keep the temperature during the drawing process uniform over the shadow mask sheet, the draw die 18 comprises a number of heat pipes 28 which ensure the temperature equalization of the surface of the draw die.

The magnetic screening properties of the drape-drawn shadow mask are adversely influenced by the drawing process. A complementary annealing treatment in a non-oxidizing atmosphere improves the magnetic screening properties. The temperature at which said complementary annealing treatment takes place is between 700° C. and 1200° C. At temperatures below 700° C. no significant improvement occurs while above 1200° C. the improvement of the screening properties does not compensate for the efforts to maintain such a high temperature. The non-oxidizing atmosphere in which the complementary annealing treatment is carried out may be, for example, a reducing hydrogen-containing nitrogen atmosphere. It has been found in practice that a nitrogen atmosphere with 6% hydrogen can successfully be used. However, the use of non-oxidizing atmospheres is not restricted to the above described example. It is also possible to use, for example, an atmosphere consisting of nitrogen alone. When the complementary annealing treatment is carried out at the same temperature at which which the shadow mask sheet is annealed, for example at 760° C., the same furnace may be used for these two annealing treatments. An annealing treatment of, for example, 10 minutes at a temperature of 760° C. provides sufficient improvement of the magnetic screening properties. The duration of the complementary annealing treatment to obtain the complete recrystallization depends upon the temperature used.

During operation of the colour display tube a considerable part of the electron flow on their way to the display screen 14 impinge on the shadow mask 15 so that heating of the shadow mask 15 occurs. For various reasons said heating should be as small as possible and/or the heat dissipation should be as large as possible. A vacuum prevails within the glass envelope 3 of the colour display tube so that heat transport by radiation is most important. The heat radiation of a surface, as is known, is highest in a so-called black body. Metals which have not been subjected to extra treatments have a reflective surface so that the share of heat transport by radiation remains of minor importance. If said share is to be increased, the metal surface should be provided with a coating layer having the properties of a black body. By subjecting the shadow mask to an treatment, at a temperature between 300° C. and 650° C. in an oxidizing atmosphere a coating layer is formed as a result of which the heat dissipation by means of radiation is increased. An treatment at 600° C. proves to give good satisfaction in practice. Said oxidation of the shadow mask is generally used.

A supporting frame 17 on which the shadow mask 15 is connected is used for suspending the shadow mask 15 in the colour display tube. In order to increase the screening of the axial magnetic interference fields it is of advantage to manufacture the supporting frame 17 from a material which has good magnetic screening properties, as is the case, for example, for an alloy of iron and nickel. Before suspending the supporting frame 17 in the colour display tube it is subjected to an oxidizing treatment so that the share of heat transport by radiation is increased. Prior to said oxidation the supporting frame is subjected to a complementary annealing treatment in a non-oxidizing gas atmosphere at a temperature between 700° C. and 1200° C. The magnetic screening properties are improved by said complementary annealing treatment. When the non-oxidizing annealing treatments of the supporting frame and the shadow mask are carried out at the same temperature, for example at 760° C., only one furnace for the non-oxidizing annealing treatments is necessary. The ultimately obtained shadow mask supporting frame combination (or shadow mask alone) not only provides a good screening of the axial magnetic interference fields in the colour display tube but since the shadow mask supporting frame combination may be considered as a box the walls of which extend in the longitudinal direction of the colour display tube, magnetic interference fields at right angles to the axial magnetic interference fields are also screened.

What is claimed is:

1. A method of manufacturing a shadow mask from a shadow mask sheet of an iron-nickel alloy, said method comprising successively the steps of:

heating the shadow mask sheet in a reducing atmosphere to produce recrystallization in the sheet, forming the shadow mask sheet into a shaped shadow mask, heating the shaped shadow mask in a non-oxidizing gas atmosphere at a temperature between 700° C. and 1200° C. to produce a substantial recrystallization in the shadow mask, and then heating the shaped shadow mask in an oxidizing atmosphere to produce an oxide layer on the shaped shadow mask.

2. The method of claim 1 wherein the steps of heating the shadow mask sheet in a reducing atmosphere and heating the formed shadow mask in a non-oxidizing gas atmosphere are carried out at substantially the same temperatures.

3. The method of claim 1 wherein the formed shadow mask, after being heated in an oxidizing atmosphere, is connected to a supporting frame manufactured from an alloy consisting essentially of iron and nickel, the frame is heated in a non-oxidizing atmosphere at a temperature of 700° C. to 1200° C. and is then heated in an oxidizing atmosphere.

4. A method as claimed in claim 1, characterized in that the alloy comprises 35 to 37% by weight of nickel.

5. A shadow mask manufactured according to claim 1.

6. A colour display tube comprising a shadow mask as claimed in claim 5.

7. A colour display tube as claimed in claim 6, characterized in that the alloy comprises 35 to 37% by weight of nickel.

* * * * *